United States Patent [19]

Cleveland

[11] 4,362,209

[45] Dec. 7, 1982

[54] CERAMIC HEAT RECUPERATIVE STRUCTURE AND ASSEMBLY

[75] Inventor: Joseph J. Cleveland, Dushore, Pa.

[73] Assignee: GTE Products Corporation, Stamford, Conn.

[21] Appl. No.: 215,307

[22] Filed: Dec. 11, 1980

Related U.S. Application Data

[63] Continuation of Ser. No. 939,094, Sep. 1, 1978, abandoned.

[51] Int. Cl.[3] ..... F28F 3/10

[52] U.S. Cl. ..... 165/166

[58] Field of Search ..... 165/165–167

[56] References Cited

U.S. PATENT DOCUMENTS

| | | | |
|---|---|---|---|
| 1,662,870 | 3/1928 | Stancliffe | 165/166 |
| 3,176,763 | 4/1965 | Fröhlich | 165/166 |
| 4,083,400 | 4/1978 | Dziedzic et al. | 165/165 |
| 4,130,160 | 12/1978 | Dziedzic et al. | 165/166 |
| 7,911,013 | 6/1973 | Morgans et al. | 165/166 |

FOREIGN PATENT DOCUMENTS

| | | | |
|---|---|---|---|
| 2529358 | 1/1976 | Fed. Rep. of Germany | 165/166 |

*Primary Examiner*—Sheldon Richter
*Attorney, Agent, or Firm*—James Theodosopoulos

[57] ABSTRACT

A heat recuperative assembly includes a cross-flow ceramic core structure of stacked ribbed layers, the ribs forming channels for the passage of heat transfer fluids, the layers sealed by ceramic cement filled in the outermost channels of each layer. In addition, the ribs adjacent the outermost ribs are more closely spaced in order to provide greater contact area for sealing.

17 Claims, 7 Drawing Figures

CERAMIC HEAT RECUPERATIVE STRUCTURE AND ASSEMBLY

CROSS REFERENCE TO RELATED APPLICATION

This application is a continuation of Ser. No. 939,094, filed Sept. 1, 1978, now abandoned and assigned to the assignee of the present invention.

BACKGROUND OF THE INVENTION

This invention relates to heat recuperators, and more particularly relates to a ceramic heat recuperative structure and recuperator assembly employing a ceramic core and a metal housing, for use on furnaces, calciners, ovens and preheaters.

Recent concern about energy conservation and rising fuel costs has caused renewed interest in industrial recuperators to recover waste heat losses and preheat incoming combustion air and/or fuel to increase the efficiency of furnaces, calciners, ovens and preheaters.

While such recuperators are usually constructed from metal parts, the ceramic recuperator has several advantages over conventional metallic recuperators. For example, ceramics in general have high corrosion resistance, high mechanical strength at elevated temperatures, low thermal expansion coefficients (TEC's) and good thermal shock resistance, and thus exhibit excellent endurance under thermal cycling; are light in weight (about one third the weight of stainless steel); and are cost competitive with high temperature alloys.

Furthermore, ceramic recuperators are available in a variety of shapes, sizes, hydraulic diameters, (hydraulic diameter is a measure of cross-sectional area divided by wetted parimeter) and compositions. Because their TEC's are typically lower than those of most metals and alloys, however, ceramic recuperators present a compatibility problem to the design engineer desiring to incorporate them into housings for retrofitting on furnaces, calciners, ovens and preheaters.

In U.S. Pat. No. 4,083,400, issued Apr. 11, 1978 and assigned to the present assignee, a ceramic cross-flow recuperator core is incorporated into a metallic housing adapted for retrofitting to the metallic fittings of existing furnaces, calciners, ovens and preheaters. Insulating and resilient sealing means between the core and housing minimize heat loss through the metallic housing and prevent leakage of heat transfer fluids, such as exhaust flue gases and incoming combustion air, past the core.

An additional problem in ceramic recuperator design is leakage of the heat transfer fluids between layers of the ceramic core structure itself, resulting in decreased overall efficiency of the recuperator apparatus. Interlayer leakage is particularly troublesome in forced-draft applications where a significant backpressure is built up on the imcoming air side of the recuperator. Such cool incoming air leaks into the hot flue or exhaust gas, reducing the heat content of that gas which would otherwise be available to heat the incoming air. In one design, alternate stacked ribbed layers form the cross-flow paths for the heat transfer fluids. While firing of stacked layers results in bonding together by sintering at points or areas of contact between the green layers, resulting in a unitary structure having mechanical strength, nevertheless deviations from planarity of the stacked green layers results in incomplete sintering together of these layers, leaving voids or cracks along the contact surfaces. Some of these voids or cracks may be evident at the visible edges or "bond lines" of the bonding surface between the outermost rib of one layer and the flat surface of the base portion of an adjacent layer.

CROSS REFERENCE TO RELATED APPLICATIONS

In U.S. Pat. No. 4,130,160, issued Dec. 19, 1978, and assigned to the present assignee, a composite ceramic recuperative structure is described in which stacked ribbed sheets or layers are comprised of sections sealed along their abutting edges.

SUMMARY OF THE INVENTION

In accordance with the invention, a ceramic cross flow recuperative structure is composed of a plurality of stacked ribbed layers or sheets, sealed together along the edge portions of the structure, and the structure is incorporated into a metallic housing adapted for coupling to the metallic fittings of furnaces, calciners, ovens and preheaters. Sealing means between the layers fills at least the channels between the two outermost ribs and their adjacent ribs for each layer, preventing leakage of heat transfer fluids such as exhaust flue gases and incoming combustion air, and thus minimizing loss of heat and consequent loss of overall efficiency of the recuperator.

In a preferred embodiment, at least one of the ribs adjacent the outermost ribs of each layer are in a more closely spaced relationship to the outermost ribs than the remaining ribs of each layer, and the channels between these closely spaced ribs are filled with the sealing means. Alternatively, the two outermost ribs may be extended in thickness during forming to eliminate the necessity for filled channels.

In sealing with another preferred embodiment, the sealing means comprises an effectively fluid-impervious ceramic cement of the same or a different composition than that of the layered material, which cement may be plastic at the firing temperature used to sinter the ceramic recuperator core structure.

The recuperative apparatus of the invention is useful to preheat incoming heating or combustion air and/or fuel and thus increase the efficiency of furnaces, calciners, ovens and preheaters of varying types and sizes.

DETAILED DESCRIPTION OF THE INVENTION

For a better understanding of the present invention, together with other and further objects, advantages, and capabilities thereof, reference is made to the following disclosure and appended claims in connection with the above-described drawings.

Figure 1:
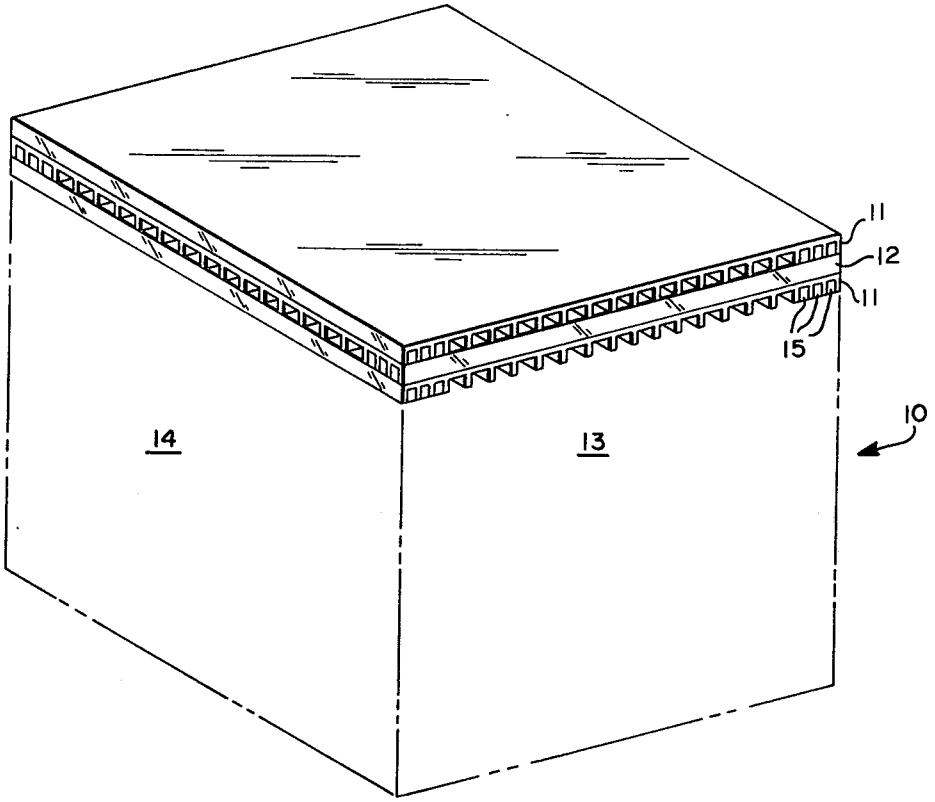
FIG. 1 is a perspective view, partly in phantom, of one embodiment of the ceramic heat recuperative core structure of the invention.

Referring now to FIG. 1, there is shown one embodiment of the ceramic recuperative structure 10 of the invention. This ceramic structure is made up of a plurality of stacked ribbed layers, 11 and 12, positioned so that the ribs of layers of 11 and 12 are transverse to one another, to form a cross flow structure having first and second pairs of opposing faces 13 and 14 defining channel openings for the passage of heat transfer fluids, in directions transverse to one another, the first fluid transferring heat to the second fluid during passage through the cells, whereby in operation each pair of faces has a hot face and a cold face, the hot face of the first pair being the inlet face for the first fluid and the hot face of the second pair being the outlet face for the second fluid.

The following table lists some exemplary ceramic materials suitable for the fabrication of ceramic recuperative structures, together with average thermal expansion coefficient (TEC values) over the range from room temperature to 800° C. in inches/inch °C. and maximum use temperatures (MUT) in degrees F.

TABLE I

| MATERIAL | (INCHES/INCH °C.) TEC | MUT |
|---|---|---|
| Mullite | 4 to 5 $\times 10^{-6}$ | 2800° F. |
| Zircon | 4 to 5 $\times 10^{-6}$ | 2600° F. |
| Magnesium Aluminum Silicate | 1 $\times 10^{-6}$ | 2400° F. |
| Porcelain | 4 $\times 10^{-6}$ | 2000° F. |
| Aluminum Oxide | 8 $\times 10^{-6}$ | 3000° F. |
| $Si_3N_4$ | 2.9 $\times 10^{-6}$ | 2500° F. |

The ribbed layers may be formed by casting, molding, extruding, tape casting and embossing, or other suitable ceramic forming technique. These layers are referred to as being in the unfired or "green" state.

Layers are stacked so that the ribs of alternate layers are transverse to one another. The stacked layers may be sealed in the green state, prior to firing, for example by filling at least the outermost channels (channels are defined as the spaces between adjacent ribs) with ceramic cement prior to or during stacking, or by forcing cement in to the channels after stacking and firing. The latter procedure usually requires additional firing in order to cure or harden the cement. Preferably one or more additional channels adjacent to the outermost channels are filled with ceramic cement. Any compatible ceramic cement such as mullite or alumina powder together with a binding agent mixed with a vehicle such as water, may be employed. The ceramic cement may be of a composition having a lower melting point than that of the layer composition so that at the firing temperatures encountered at a later stage in processing, the cement will assume a plastic state, flowing into irregularities in the bonding surfaces of the ribs and thereby achieving an adequate seal between the layers. The cement may even be porous, so long as the pores are not interconnected, which would of course destroy the fluid-impervious character thereof.

Preferably, as shown in FIG. 1, a plurality of ribs adjacent the outermost ribs are in a more closely spaced relationship with the outermost ribs than with the remaining ribs.

This closely-spaced relationship provides greater surface for contact between the top surface of the ribs of one layer and the bottom surface of the next layer, and thus greater opportunity for sealing by sintering together during firing. In this embodiment, filling the channels with cement is an added feature to insure substantially complete sealing.

Figure 6:
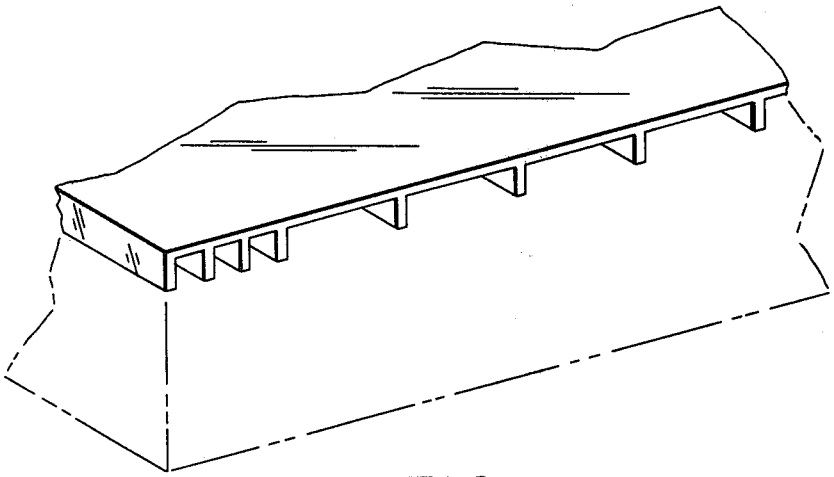
FIG. 6 is a perspective view, partly in phantom, of another embodiment of the ceramic heat recuperative core structure of FIG. 1.

However, in the embodiment shown in FIG. 6, the channels are left open. This embodiment would be useful in applications where maximum fluid flow is of greater importance than maximum sealing.

Figure 7:
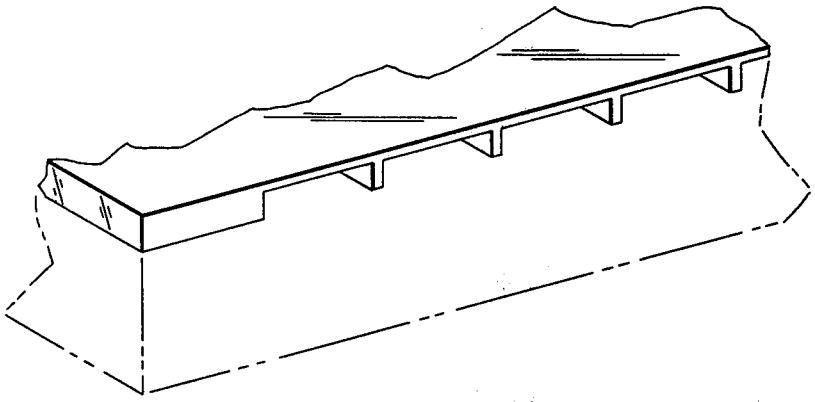
FIG. 7 is a perspective view, partly in phantom, of still another embodiment of the ceramic heat recuperative core structure of FIG. 1.

FIG. 7 shows another embodiment in which the ribbed sheet is initially formed with a solid portion extending from the base of the sheet in place of the closely spaced ribs of the embodiments of FIGS. 1 and 6. This embodiment eliminates a necessity for filling of the channels with cement to achieve substantially complete sealing.

This embodiment also permits more widely spaced ribs in the central portion of the incoming air side, which is particularly advantageous in forced draft applications in which the recuperator must accommodate a large volume of air flow.

Suitable materials for the formation of a cast ceramic insert are castable compositions of the materials shown in Table II, along with their average thermal expansion coefficients (TEC's) in inches/inch/°C. measured over the range from room temperature to 800° C., and maximum used temperatures (MUT) in degrees F.

TABLE II

| MATERIAL | TEC | MUT |
|---|---|---|
| Aluminum Oxide | 8 $\times 10^{-6}$ | 3000° F. |
| Zircon | 4 to 5 $\times 10^{-6}$ | 3000° F. |
| Mullite | 4 to 5 $\times 10^{-6}$ | 3300° F. |
| Zirconia | 9 to 10 $\times 10^{-6}$ | 4000° F. |

Figure 2:
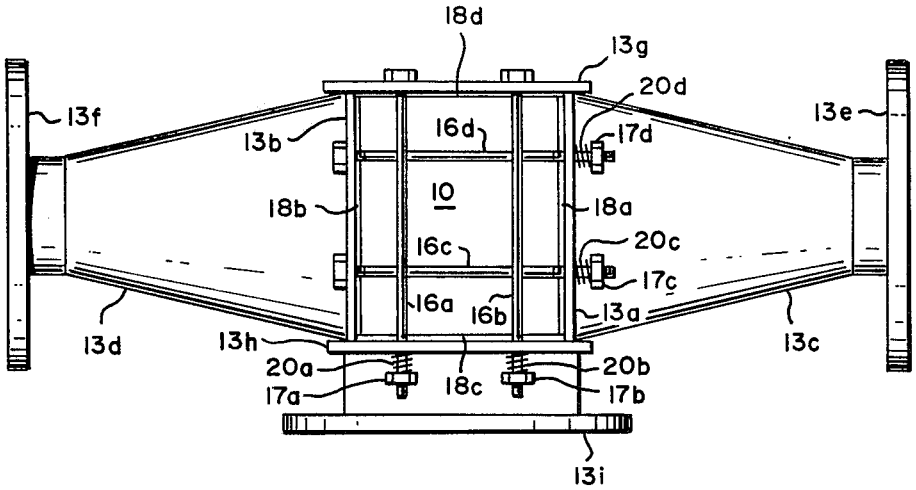
FIG. 2 is a front elevational view, of the assembly of a ceramic core in one embodiment of a metallic housing.

Referring now to FIG. 2, there is shown a front elevational view, partly in section, of the assembly of the invention wherein ceramic recuperative structure 10 of FIG. 1 is enclosed in a housing comprising plate portions **13*a* and 13*b* defining apertures terminating in tapered conduit portions 13*c* and 13*d* having flanged portions 13*e* and 13*f* for connection with the incoming heating or combustion air or fuel line. Plate portions 13*g* or 13*h* define apertures terminating in flanged portion 13*i* for connection to the exhaust heat for flue gas output. Plate portions 13*a*, *b*, *g* and *h* are held in firm contact with ceramic recuperator faces by bolts 16*a*, *b*, *c* and *d* and nuts 17*a*, *b*, *c* and *d*. Bolts 16 and nuts 17 are provided with helical springs 20*a*, *b*, *c* and *d* which act as bias elements permitting expansion and contraction of the bolts during thermal cycling, while maintaining intimate contact between the plate portions 13 and ceramic faces, not shown. After placement of the structure in the housing, a ceramic insert (not shown) preferably cast in situ, may be positioned to protrude beyond the opening in plate 13*h* and contact the mating surface of a ceramic lining of an exhaust or flue gas opening or conduit. Flange 13*i* connects to the flue gas conduit or furnace housing and maintains the ceramic members in intimate contact. Plate 13*g*** may also serve as a flange for connection to the flue gas conduit.

Because of the large differences in thermal expansion coefficients between most ceramics and most metals, a resilient sealing means of a material to withstand the envisioned temperature of operation, may desirably be placed between the ceramic core structure and the metallic housing. Such a resilient sealing means is shown in FIG. 2 as layers 18*a, b, c* and *d*. It will be appreciated by those skilled in the art that accompanying insulating means between the core structure and the housing will not only increase the efficiency of operation of the recuperator assembly, but will also lower the temperature at the internal surface of the housing enabling use of lower maximum temperature resilient sealing means than would otherwise be possible. Of course, the choice of materials including composite materials, exhibiting both insulating and resilient sealing properties is contemplated as being within the scope of the invention. An outstanding example of such a material is a compressible ceramic paper composed of a porous mullite composition.

Figure 3:
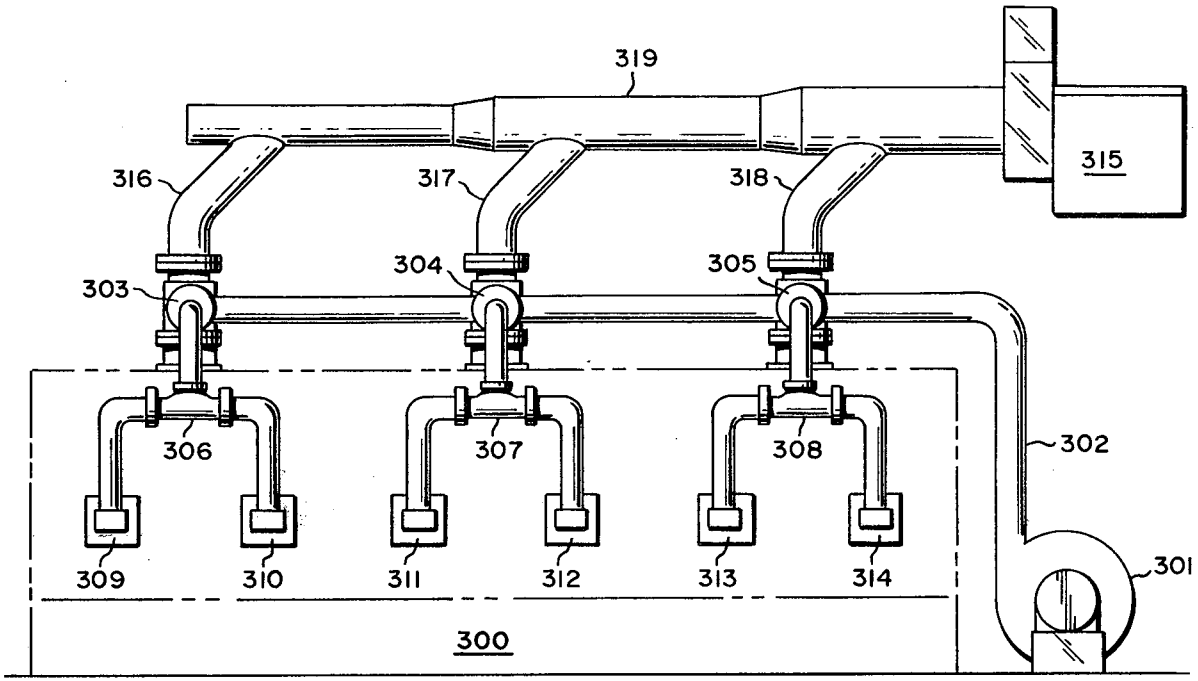
FIG. 3 is a side elevational view of a heat recuperative system employing a series of recuperator assemblies of the invention on a tunnel-type furnace.

Referring now to FIG. 3, there is shown in side elevational view an arrangement wherein a series of three recuperators of the invention are installed on a tunnel kiln 30 employing six gas burners. Blower 301 supplies combustion air through conduit 302 to recuperators 303, 304 and 305, and thence the preheated air is delivered through conduits 306, 307 and 308 to gas burners 309, 310, 311, 312, 313 and 314. Flue gas combustion products are drawn by blower 315 through recuperators 303, 304, and 305, and thence through ducts 316, 317 and 318 to flue gas exhaust manifold 319.

Figure 4:
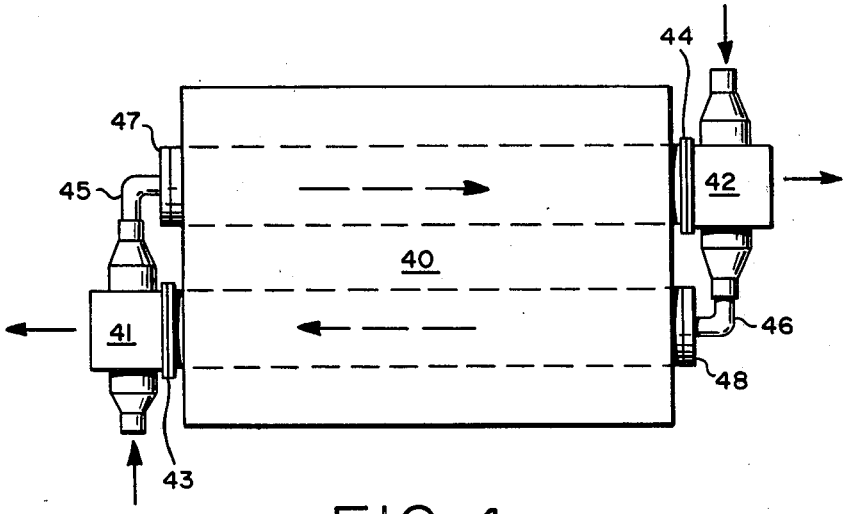
FIG. 4 is a schematic diagram of a heat recuperative system employing two recuperator assemblies of the invention on a two-burner horizontal radiant tube furnace.
Figure 5:
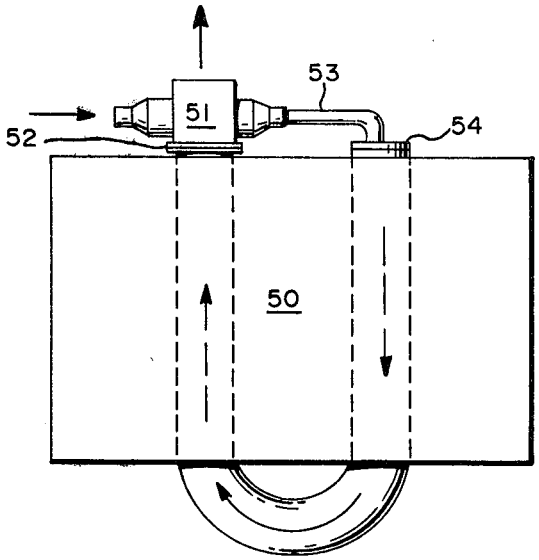
FIG. 5 is a schematic diagram of a similar system for a single-burner verticle "U" radiant tube furnace.

Referring now to FIG. 4, there is shown in schematic form an arrangement whereby recuperators 41 and 42 are installed on the exhaust ports 43 and 44 a two-burner horizontal radiant tube furnace 40. Preheated combustion air is supplied through conduits 45 and 46 to burner inlets 47 and 48. FIG. 5 shows a similar arrangement for a vertical "U" radiant tube furnace 50 employing a single burner. Recuperator 51 is installed on the exhaust port 52 and preheated combustion air is supplied through conduit 53 to burner inlet 54.

While there has been shown and described what are at present considered the preferred embodiments of the invention, it will be obvious to those skilled in the art that various changes and modifications may be made therein without departing from the scope of the invention as defined by the appended claims.

What is claimed is:

1. A cross flow ceramic recuperative core structure, having first and second pairs of opposing faces defining channel openings for the passage of heat transfer fluids respectively, in directions transverse to one another, the first fluid transferring heat to the second fluid during passage through the channels, whereby each pair of faces has in operation a hot face and a cold face, the hot face of the first pair being the inlet face for the first fluid and the hot face of the second pair being the outlet face for the second fluid, characterized in that the structure is composed of a plurality of stacked ribbed layers, each layer having opposing first and second sides and a plurality of upstanding ribs positioned on the first side thereof, the ribs substantially parallel to one another and substantially perpendicular to the side of the layer, the layers stacked so that the ribs of one layer are in substantial contact with the second side of an adjacent layer, and so that the ribs of adjacent layers are alternately transverse to one another, each layer having two outermost ribs and two outermost channels, each outermost channel comprising the space between each outermost rib and its respective adjacent rib, each outermost channel being filled with ceramic cement, said ceramic cement forming a seal that substantially prevents leakage of heat transfer fluids between adjacent layers.

2. The ceramic structure of claim 1 in which the ceramic cement is a material having a lower melting point than the melting point of the layer material.

3. A cross flow ceramic recuperative core structure, having first and second pairs of opposing faces defining channel openings for the passage of heat transfer fluids respectively, in directions transverse to one another, the first fluid transferring heat to the second fluid during passage through the channels, whereby each pair of faces has in operation a hot face and a cold face, the hot face of the first pair being the inlet face for the first fluid and the hot face of the second pair being the outlet face for the second fluid, characterized in that the ceramic structure is composed of a plurality of stacked ribbed layers, each layer having opposing first and second sides and a plurality of upstanding ribs positioned on the first side thereof, the ribs substantially parallel to one another and substantially perpendicular to the side of the layer, the layers stacked so that the ribs of one layer are in substantial contact with the second side of an adjacent layer, and so that the ribs of adjacent layers are alternately transverse to one another, and sealing means positioned within at least the outermost two channels of each layer, the sealing means substantially preventing leakage of heat transfer fluids, in which at least one of the ribs adjacent to the two outermost ribs of each layer is in a more closely spaced relationship to the outermost rib than the remaining ribs of each layer, and in which cement is positioned within the channels between the closely spaced ribs of each layer.

4. A heat recuperative apparatus comprising a cross flow recuperative ceramic core structure, having first and second pairs of opposing faces defining cell openings for the passage of first and second heat transfer fluids respectively, in directions transverse to one another, the first fluid transferring heat to the second fluid during passage through the cells, whereby each pair of faces has in operation a hot face and a cold face, the hot face of the first pair being the inlet face for the first fluid, and the hot face of the second pair being the outlet face for the second fluid, a metallic housing surrounding the core structure, the housing defining openings communicating with the structure channel openings, the housing openings adapted for coupling to external fluid conduits, and means for maintaining a seal between the cellular structure and the housing to promote passage of heat transfer fluids through the structure channels;

characterized in that the ceramic structure is composed of a plurality of stacked ribbed layers, each layer having opposing first and second sides and a plurality of upstanding ribs positioned on the first side thereof, the ribs substantially parallel to one another and substantially perpendicular to the side of the layer, the layers stacked so that the ribs of one layer are in substantial contact with the second side of an adjacent layer, and so that the ribs of adjacent layers are alternately transverse to one another, each layer having two outermost ribs and two outermost channels, each outermost channel comprising the space between each outermost rib and its respective adjacent rib, each outermost channel being filled with ceramic cement, said ceramic cement forming a seal that substantially prevents leakage of heat transfer fluids between adjacent layers.

5. The heat recuperative apparatus of claim 4 in which the ceramic cement is a material having a lower melting point than the melting point of the layer material.

6. A heat recuperative apparatus comprising a cross flow recuperative ceramic core structure, having first and second pairs of opposing faces defining cell openings for the passage of first and second heat transfer fluids respectively, in directions transverse to one another, the first fluid transferring heat to the second fluid during passage through the cells, whereby each pair of faces has in operation a hot face and a cold face, the hot face of the first pair being the inlet face for the first fluid, and the hot face of the second pair being the outlet face for the second fluid, a metallic housing surrounding the core structure, the housing defining openings communicating with the structure channel openings, the housing openings adapted for coupling to external fluid conduits, and means for maintaining a seal between the cellular structure and the housing to promote passage of heat transfer fluids through the structure channels;

characterized in that the ceramic structure is composed of a plurality of stacked ribbed layers, each layer having opposing first and second sides and a plurality of upstanding ribs positioned on the first side thereof, the ribs substantially parallel to one another and substantially perpendicular to the side of the layer, the layers stacked so that the ribs of one layer are in substantial contact with the second side of an adjacent layer, and so that the ribs of adjacent layers are alternately transverse to one another, and sealing means positioned within at least the outermost two channels of each layer, the sealing means substantially preventing leakage of heat transfer fluids between adjacent layers, in which at least one of the ribs adjacent to the two outermost ribs of each layer is in a more closely spaced relationship to the outermost rib than the remaining ribs of each layer, and in which the cement is positioned within the channels between the closely spaced ribs of each layer.

7. A cross flow ceramic recuperative core structure, having first and second pairs of opposing faces defining channel openings for the passage of heat transfer fluids, respectively, in directions transverse to one another, the first fluid transferring heat to the second fluid during passage through the channels, whereby each pair of faces has in operation a hot face and a cold face, the hot face of the first pair being the inlet face for the first fluid and hot face of the second pair being the outlet face for the second fluid characterized in that the ceramic structure is composed of a plurality of stacked ribbed layers, each layer having opposing first and second sides and a plurality of upstanding ribs positioned on the first side thereof, the ribs substantially parallel to one another and substantially perpendicular to the side of the layer, the layers stacked so that the ribs of one layer are in substantial contact with the second side of an adjacent layer, and so that the ribs of adjacent layers are alternately transverse to one another, at least one of the ribs adjacent to the two outermost ribs of ech layer in a more closely spaced relationship to the outermost rib than the remaining ribs of each layer in which sealing means is positioned within at least the outermost two channels of each layer.

8. The ceramic structure of claim 7 in which the sealing means comprises an effectively fluid-impervious ceramic cement.

9. The ceramic structure of claim 8 in which the ceramic cement is a material having a lower melting point than the melting point of the layer material.

10. A heat recuperative apparatus comprising a cross flow recuperative ceramic core structure, having first and second pairs of opposing faces defining cell openings for the passage of first and second heat transfer fluids respectively, in directions transverse to one another, the first fluid transferring heat to the second fluid during passage through the cells, whereby each pair of faces has in operation a hot face and a cold face, the hot face of the first pair being the inlet face for the first fluid, and the hot face of the second pair being the outlet face for the second fluid, a metallic housing surrounding the core structure, the housing defining openings communicating with the structure channel openings, the housing openings adapted for coupling to external fluid conduits, and means for maintaining a seal between the cellular structure and the housing to promote passage of heat transfer fluids through the structure channels;

characterized in that the ceramic structure is composed of a plurality of stacked ribbed layers, each layer having opposing first and second sides and a plurality of upstanding ribs positioned on the first side thereof, the ribs substantially parallel to one another and substantially perpendicular to the side of the layer, the layers stacked so that the ribs of one layer are in substantial contact with the second side of an adjacent layer, and so that the ribs of adjacent layers are alternately transverse to one another, at least one of the ribs adjacent to the two outermost ribs of each layer in a more closely spaced relationship to the outermost rib than the remaining ribs of each layer, in which sealing means is positioned within at least the outermost two channels of each layer.

11. The heat recuperative apparatus of claim 10 in which the sealing means comprises an effectively fluid-impervious ceramic cement.

12. The heat recuperative apparatus of claim 11 in which the ceramic cement is a material having a lower melting point than the melting point of the layer material.

13. A cross flow ceramic recuperative core structure, having first and second pairs of opposing faces defining channel openings for the passage of heat transfer fluids respectively, in directions transverse to one another, the first fluid transferring heat to the second fluid during passage through the channels, whereby each pair of faces has in operation a hot face and a cold face, the hot face of the first pair being the inlet face for the first fluid and the hot face of the second pair being the outlet face for the second fluid, characterized in that the ceramic structure is composed of a plurality of stacked ribbed layers, the layers stacked so that the ribs of alternate layers are transverse to one another, and sealing means positioned within at least the outermost two channels of each layer, the sealing means substantially preventing leakage of heat transfer fluids between adjacent layers, at least one of the ribs adjacent to the two outermost ribs of each layer being in a more closely spaced relationship to the outermost rib than the remaining ribs of each layer, and in which cement is positioned within the channels between the closely spaced ribs of each layer.

14. A heat recuperative apparatus comprising a cross flow recuperative ceramic core structure, having first and second pairs of opposing faces defining cell openings for the passage of first and second heat transfer fluids respectively, in directions transverse to one another, the first fluid transferring heat to the second fluid during passage through the cells, whereby each pair of faces has in operation a hot face and a cold face, the hot face of the first pair being the inlet face for the first fluid, and the hot face of the second pair being the outlet face for the second fluid, a metallic housing surrounding the core structure, the housing defining openings communicating with the structure channel openings, the housing adapted for coupling to external fluid conduits, and means for maintaining a seal between the cellular structure and the housing to promote passage of heat transfer fluids through the structure channels;

characterized in that the ceramic structure is composed of a plurality of stacked ribbed layers, the layers stacked so that the ribs of alternate layers are transverse to one another, and sealing means positioned within at least the outermost two channels of each layer, the sealing means substantially preventing leakage of heat transfer fluids between adjacent layers, at least one of the ribs adjacent to the two outermost ribs of each layer being in a more closely spaced relationship to the outermost rib than the remaining ribs of each layer, and in which cement is positioned within the channels between the closely spaced ribs of each layer.

15. A cross flow ceramic recuperative core structure, having first and second pairs of opposing faces defining channel openings for the passage of heat transfer fluids respectively, in directions transverse to one another, the first fluid transferring heat to the second fluid during passage through the channels, whereby each pair of faces has in operation a hot face and a cold face, the hot face of the first pair being the inlet face for the first fluid and the hot face of the second pair being the outlet face for the second fluid, characterized in that the ceramic structure is composed of a plurality of stacked ribbed layers, the layers stacked so that the ribs of alternate layers are transverse to one another, at least one of the ribs adjacent to the two outermost ribs of each layer in a more closely spaced relationship to the outermost rib than the remaining ribs of each layer, sealing means being positioned within at least the outermost two channels of each layer.

16. A heat recuperative apparatus comprising a cross flow recuperative ceramic core structure, having first and second pairs of opposing faces defining cell openings for the passage of first and second heat transfer fluids respectively, in directions transverse to one another, the first fluid transferring heat to the second fluid during passage through the cells, whereby each pair of faces has in operation a hot face and a cold face, the hot face of the first pair being the inlet face for the first fluid, and the hot face of the second pair being the outlet face for the second fluid, a metallic housing surrounding the core structure, the housing defining openings communicating with the structure channel openings, the housing openings adapted for coupling to external fluid conduits, and means for maintaining a seal between the cellular structure and the housing to promote passage of heat transfer fluids through the structure channels;

characterized in that the ceramic structure is composed of a plurality of stacked ribbed layers, the layers stacked so that the ribs of alternate layers are transverse to one another, at least one of the ribs adjacent to the two outermost ribs of each layer in a more closely spaced relationship to the outermost rib than the remaining ribs of each layer, and sealing means positioned within at least the outermost two channels of each layer.

17. The heat recuperative apparatus of claim 16 in which the ceramic cement is a material having a lower melting point that the melting point of the layer material.

* * * * *